US012610987B2

(12) United States Patent
Atkins et al.

(10) Patent No.: US 12,610,987 B2
(45) **Date of Patent: *Apr. 28, 2026**

(54) CARTRIDGES FOR VAPORIZER DEVICES

(71) Applicant: JUUL Labs, Inc., Washington, DC (US)

(72) Inventors: Ariel Atkins, San Francisco, CA (US); Alexander M. Hoopai, San Francisco, CA (US); Esteban Leon Duque, Berkeley, CA (US); Christopher James Rosser, Cambridge (GB); Andrew J. Stratton, Royston (GB); Norbert Wesely, Sopron (HU)

(73) Assignee: JUUL Labs, Inc., Washington, DC (US)

( * ) Notice: Subject to any disclaimer, the term of this patent is extended or adjusted under 35 U.S.C. 154(b) by 133 days.

This patent is subject to a terminal disclaimer.

(21) Appl. No.: 18/762,475

(22) Filed: Jul. 2, 2024

(65) Prior Publication Data

US 2024/0358080 A1 Oct. 31, 2024

Related U.S. Application Data

(63) Continuation of application No. 16/674,583, filed on Nov. 5, 2019, now Pat. No. 12,053,024.
(Continued)

(51) Int. Cl.
*A24F 40/485* (2020.01)

(52) U.S. Cl.
CPC ..... *A24F 40/485* (2020.01)

(58) Field of Classification Search
None
See application file for complete search history.

(56) References Cited

U.S. PATENT DOCUMENTS

2016/0334119 A1 11/2016 Cameron
2018/0027883 A1 2/2018 Zuber et al.
(Continued)

FOREIGN PATENT DOCUMENTS

CA 3040029 A1 7/2018
CN 108289505 A 7/2018
(Continued)

*Primary Examiner* — Michael H. Wilson
*Assistant Examiner* — Daniel Edward Vakili
(74) *Attorney, Agent, or Firm* — Mintz, Levin, Cohn, Ferris, Glovsky and Popeo, P.C.

(57) ABSTRACT

Cartridges for vaporizer devices are provided. In one exemplary embodiment, the cartridge can include a primary reservoir, a secondary reservoir in fluid communication with the primary reservoir, and a vaporization chamber in communication with the secondary reservoir in which the vaporization chamber includes a first wicking element. The primary reservoir is configured to store a majority fraction of vaporizable material when in a first pressure state and configured to expel the vaporizable material in response to an increase in headspace when in a second pressure state. The secondary reservoir is formed of absorbent material configured to receive a first volume of the vaporizable material from the primary reservoir in the first pressure state and to receive a second volume of the vaporizable material from the primary reservoir in the second pressure state in which the second volume is greater than the first volume. Vaporizer devices are also provided.

20 Claims, 3 Drawing Sheets

Related U.S. Application Data

(60) Provisional application No. 62/755,895, filed on Nov. 5, 2018.

(56) References Cited

U.S. PATENT DOCUMENTS

| | | | | |
|---|---|---|---|---|
| 2018/0146711 | A1 | 5/2018 | Mazur et al. | |
| 2018/0177240 | A1 | 6/2018 | Duque et al. | |
| 2018/0242642 | A1 | 8/2018 | Silvesstrini et al. | |
| 2018/0263293 | A1 | 9/2018 | Tucker et al. | |
| 2018/0297047 | A1 | 10/2018 | Tong | |
| 2018/0310621 | A1 | 11/2018 | Borkovec et al. | |
| 2019/0350267 | A1* | 11/2019 | Tucker ..... | H05B 1/0244 |

FOREIGN PATENT DOCUMENTS

| | | | |
|---|---|---|---|
| CN | 110325060 | A | 10/2019 |
| EA | 028687 | B1 | 12/2017 |
| EP | 2925395 | A1 | 10/2015 |
| KR | 10-2017-0003971 | A | 1/2017 |
| KR | 10-2017-0086128 | A | 7/2017 |
| RU | 107026 | U1 | 8/2011 |
| RU | 2655188 | C2 | 5/2018 |
| WO | WO-2017139595 | A1 | 8/2017 |
| WO | WO-2017207418 | A1 | 12/2017 |
| WO | WO-2018125934 | A1 | 7/2018 |

* cited by examiner

CARTRIDGES FOR VAPORIZER DEVICES

CROSS-REFERENCE TO RELATED APPLICATIONS

This application is a continuation of U.S. patent application Ser. No. 16/674,583 filed on Nov. 15, 2019, and entitled 'Cartridges for Vaporizer Devices," which claims priority to U.S. Provisional Patent Application No. 62/755,895 filed on Nov. 5, 2018, and entitled "Cartridges For Vaporizer Devices," the disclosures of which is are incorporated herein by reference in their entireties.

TECHNICAL FIELD

The subject matter described herein relates to vaporizer devices, including vaporizer cartridges.

BACKGROUND

Vaporizer devices, which can also be referred to as vaporizers, electronic vaporizer devices, or e-vaporizer devices, can be used for delivery of an aerosol (for example, a vapor-phase and/or condensed-phase material suspended in a stationary or moving mass of air or some other gas carrier) containing one or more active ingredients by inhalation of the aerosol by a user of the vaporizing device. For example, electronic nicotine delivery systems (ENDS) include a class of vaporizer devices that are battery powered and that can be used to simulate the experience of smoking, but without burning of tobacco or other substances. Vaporizer devices are gaining increasing popularity both for prescriptive medical use, in delivering medicaments, and for consumption of tobacco, nicotine, and other plant-based materials. Vaporizer devices can be portable, self-contained, and/or convenient for use.

In use of a vaporizer device, the user inhales an aerosol, colloquially referred to as "vapor," which can be generated by a heating element that vaporizes (e.g., causes a liquid or solid to at least partially transition to the gas phase) a vaporizable material, which can be liquid, a solution, a solid, a paste, a wax, and/or any other form compatible for use with a specific vaporizer device. The vaporizable material used with a vaporizer device can be provided within a cartridge for example, a separable part of the vaporizer device that contains vaporizable material) that includes an outlet (for example, a mouthpiece) for inhalation of the aerosol by a user.

To receive the inhalable aerosol generated by a vaporizer device, a user may, in certain examples, activate the vaporizer device by taking a puff, by pressing a button, and/or by some other approach. A puff as used herein can refer to inhalation by the user in a manner that causes a volume of air to be drawn into the vaporizer device such that the inhalable aerosol is generated by a combination of the vaporized vaporizable material with the volume of air.

An approach by which a vaporizer device generates an inhalable aerosol from a vaporizable material involves heating the vaporizable material in a vaporization chamber (e.g., a heater chamber) to cause the vaporizable material to be converted to the gas (or vapor) phase. A vaporization chamber can refer to an area or volume in the vaporizer device within which a heat source (for example, a conductive, convective, and/or radiative heat source) causes heating of a vaporizable material to produce a mixture of air and vaporized material to form a vapor for inhalation of the vaporizable material by a user of the vaporizer device.

Vaporizer devices can be controlled by one or more controllers, electronic circuits (for example, sensors, heating elements), and/or the like on the vaporizer device. Vaporizer devices can also wirelessly communicate with an external controller for example, a computing device such as a smartphone).

In some implementations, the vaporizable material can be drawn out of a reservoir and into the vaporization chamber via a wicking element (e.g., a wick). Drawing of the vaporizable material into the vaporization chamber can be at least partially due to capillary action provided by the wicking element as the wicking element pulls the vaporizable material along the wicking element in the direction of the vaporization chamber. However, as vaporizable material is drawn out of the reservoir, the pressure inside the reservoir is reduced, thereby creating a vacuum and acting against the capillary action. Ambient air then takes the place of the vacuum created in the reservoir's empty space. It is noteworthy that often unused cartridges also include some air (e.g., bubbles) because completely filling a cartridge's reservoir remains a manufacturing challenge.

Application of heat, manual pressure, or any type of negative pressure event (e.g., pressure drop inside an airplane cabin) may cause the air volume or bubbles in a cartridge reservoir to expand as the ambient pressure becomes negative in relation to the internal pressure. Disadvantageously, such pressure changes result in the vaporizable material overflowing out of the body of the cartridge where an opening is present. These undesirable leaks typically occur at an end where the cartridge reservoir is connected to a mouthpiece or in a cavity area where a cartridge's electric ports are positioned to engage a power source.

Vaporizable material leaks are problematic because such leaks typically interfere with the functionality and cleanliness of the vaporizer device (e.g., leaked vaporizable material plugs the electric ports or makes a mess that requires cleaning). Additionally, user experience is negatively impacted by leakage of vaporizable material from a cartridge due to the possibility of staining or damaging other articles or fabrics adjacent to a leaking cartridge. Leaks into certain parts of a cartridge or a vaporizer device may also result in liquid vaporizable material bypassing vaporization chamber, thereby causing a user to experience unpleasant sensations from inhaling the vaporizable material in the liquid form.

Accordingly, vaporizer devices and/or vaporizer cartridges that address one or more of these issues are desired.

SUMMARY

Aspects of the current subject matter relate to vaporizer devices and to cartridges for use in a vaporizer device.

In some variations, one or more of the following features may optionally be included in any feasible combination.

In one exemplary embodiment, a cartridge is provided and includes a primary reservoir having a first pressure state and a second pressure state, a secondary reservoir in fluid communication with the primary reservoir, and a vaporization chamber in communication with the secondary reservoir. The primary reservoir is configured to store a majority fraction of vaporizable material therein when in the first pressure state and configured to expel the vaporizable material in response to an increase in headspace when in the second pressure state. The secondary reservoir is formed of an absorbent material. The absorbent material is configured to receive a first volume of the vaporizable material from the primary reservoir in the first pressure state and to receive a second volume of the vaporizable material from the primary reservoir in the second pressure state in which the second volume is greater than the first volume. The vaporization chamber includes a first wicking element that is configured to draw the vaporizable material from the secondary reservoir chamber into the vaporization chamber for vaporization by a heating element.

In some embodiments, the second pressure state can be associated with a negative pressure event.

In some embodiments, in the first pressure state, an internal pressure of the primary reservoir can be less than or equal to ambient pressure.

In some embodiments, in the second pressure state, an internal pressure of the reservoir can be greater than the ambient pressure.

In some embodiments, the cartridge can include a second wicking element extending from the primary reservoir to the secondary reservoir. The second wicking element can be configured to draw the vaporizable material from the primary reservoir into the secondary reservoir.

In some embodiments, the first volume of the vaporizable material can flow from the primary reservoir into the secondary reservoir at a first flow rate. In such embodiments, the second volume of the vaporizable material can flow from the primary reservoir into the secondary reservoir at a second flow rate that is greater than the first flow rate.

In another exemplary embodiment, a cartridge is provided and includes a primary reservoir having an internal pressure, a secondary reservoir being formed of an absorbent material, a first wicking element extending between the primary and secondary reservoirs, and a vaporization chamber in communication with the secondary reservoir. The primary reservoir is configured to hold a majority fraction of vaporizable material. The first wicking element is configured to draw the vaporizable material from the primary reservoir into the secondary reservoir. The vaporization chamber includes a second wicking element configured to draw the vaporizable material from the secondary reservoir to the vaporization chamber for vaporization by a heating element. The absorbent material is configured to receive an overflow volume of the vaporizable material that is expelled from the primary reservoir in response to a pressure differential that is created between ambient pressure outside of the primary reservoir and the internal pressure of the primary reservoir.

In some embodiments, the pressure differential can be associated with a negative pressure event.

In some embodiments, the internal pressure of the primary reservoir can be less than or equal to the ambient pressure prior to the pressure differential being created. In other embodiments, the ambient pressure can be less than the internal pressure of the primary reservoir when the pressure differential is created.

In some embodiments, the second wicking element can be configured to draw the overflow volume of the vaporizable material from the secondary reservoir to the vaporization chamber. In other embodiments, the first wicking element can be configured to withdraw at least a portion of the overflow volume of the vaporizable material from the secondary reservoir back to the primary reservoir in response to a decrease of the pressure differential.

In some embodiments, the vaporization chamber can also include a third wicking element that can be configured to draw the vaporizable material from the secondary reservoir to the vaporization chamber for vaporization by the heating element.

In another exemplary embodiment, a vaporizer device is provided and includes a vaporizer body and a cartridge that is selectively coupled to and removable from the vaporizer body. The cartridge includes a primary reservoir having a first pressure state and a second pressure state, a secondary reservoir in fluid communication with the primary reservoir, and a vaporization chamber in communication with the secondary reservoir. The primary reservoir is configured to store a majority fraction of vaporizable material therein when in the first pressure state and configured to expel the vaporizable material in response to an increase in headspace when in the second pressure state. The secondary reservoir is formed of an absorbent material. The absorbent material is configured to receive a first volume of the vaporizable material from the primary reservoir in the first pressure state and to receive a second volume of the vaporizable material from the primary reservoir in the second pressure state in which the second volume is greater than the first volume. The vaporization chamber includes a first wicking element that is configured to draw the vaporizable material from the secondary reservoir chamber into the vaporization chamber for vaporization by a heating element.

The vaporizer body can have a variety of configurations. In some embodiments, the vaporizer body can include a power source.

In some embodiments, the second pressure state can be associated with a negative pressure event.

In some embodiments, in the first pressure state, an internal pressure of the primary reservoir can be less than or equal to ambient pressure.

In some embodiments, in the second pressure state, an internal pressure of the reservoir can be greater than the ambient pressure.

In some embodiments, the cartridge can include a second wicking element extending from the primary reservoir to the secondary reservoir. The second wicking element can be configured to draw the vaporizable material from the primary reservoir into the secondary reservoir.

In some embodiments, the first volume of the vaporizable material can flow from the primary reservoir into the secondary reservoir at a first flow rate. In such embodiments, the second volume of the vaporizable material can flow from the primary reservoir into the secondary reservoir at a second flow rate that is greater than the first flow rate.

The details of one or more variations of the subject matter described herein are set forth in the accompanying drawings and the description below. Other features and advantages of the subject matter described herein will be apparent from the description and drawings, and from the claims. The claims that follow this disclosure are intended to define the scope of the protected subject matter.

BRIEF DESCRIPTION OF THE DRAWINGS

The accompanying drawings, which are incorporated into and constitute a part of this specification, show certain aspects of the subject matter disclosed herein and, together with the description, help explain some of the principles associated with the disclosed implementations. In the drawings.

When practical, similar reference numbers denote similar structures, features, or elements.

DETAILED DESCRIPTION

Implementations of the current subject matter include methods, apparatuses, articles of manufacture, and systems relating to vaporization of one or more materials for inhalation by a user. Example implementations include vaporizer devices and systems including vaporizer devices. The term "vaporizer device" as used in the following description and claims refers to any of a self-contained apparatus, an apparatus that includes two or more separable parts (for example, a vaporizer body that includes a battery and other hardware, and a cartridge that includes a vaporizable material), and/or the like. A "vaporizer system," as used herein, can include one or more components, such as a vaporizer device. Examples of vaporizer devices consistent with implementations of the current subject matter include electronic vaporizers, electronic nicotine delivery systems (ENDS), and/or the like. In general, such vaporizer devices are hand-held devices that heat (such as by convection, conduction, radiation, and/or some combination thereof) a vaporizable material to provide an inhalable dose of the material.

The vaporizable material used with a vaporizer device can be provided within a cartridge (for example, a part of the vaporizer device that contains the vaporizable material in a reservoir or other container) which can be refillable when empty, or disposable such that a new cartridge containing additional vaporizable material of a same or different type can be used). A vaporizer device can be a cartridge-using vaporizer device, a cartridge-less vaporizer device, or a multi-use vaporizer device capable of use with or without a cartridge. For example, a vaporizer device can include a heating chamber (for example, an oven or other region in which material is heated by a heating element) configured to receive a vaporizable material directly into the heating chamber, and/or a reservoir or the like for containing the vaporizable material.

In some implementations, a vaporizer device can be configured for use with a liquid vaporizable material (for example, a carrier solution in which an active and/or inactive ingredient(s) are suspended or held in solution, or a liquid form of the vaporizable material itself). The liquid vaporizable material can be capable of being completely vaporized. Alternatively, at least a portion of the liquid vaporizable material can remain after all of the material suitable for inhalation has been vaporized.

Figure 1A:
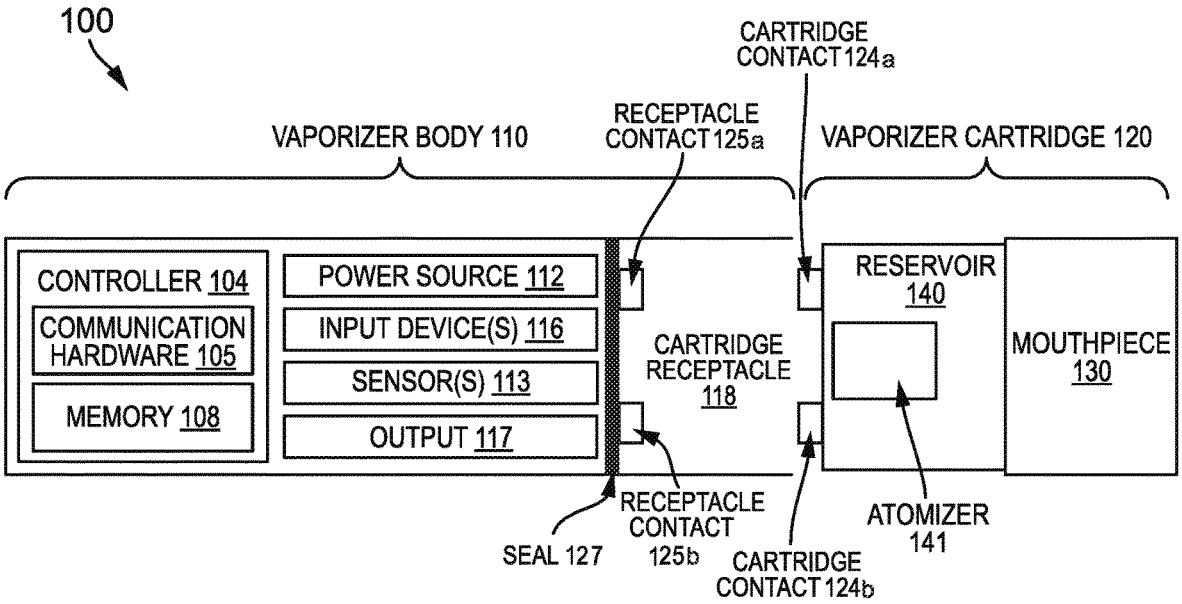
FIG. 1A is a block diagram of a vaporizer device.

Referring to the block diagram of FIG. 1A, a vaporizer device 100 can include a power source 112 (for example, a battery, which can be a rechargeable battery), and a controller 104 (for example, a processor, circuitry, etc. capable of executing logic) for controlling delivery of heat to an atomizer 141 to cause a vaporizable material 102 to be converted from a condensed form (such as a liquid, a solution, a suspension, a part of an at least partially unprocessed plant material, etc.) to the gas phase. The controller 104 can be part of one or more printed circuit boards (PCBs) consistent with certain implementations of the current subject matter.

After conversion of the vaporizable material 102 to the gas phase, at least some of the vaporizable material 102 in the gas phase can condense to form particulate matter in at least a partial local equilibrium with the gas phase as part of an aerosol, which can form some or all of an inhalable dose provided by the vaporizer device 100 during a user's puff or draw on the vaporizer device 100. It should be appreciated that the interplay between gas and condensed phases in an aerosol generated by a vaporizer device 100 can be complex and dynamic, due to factors such as ambient temperature, relative humidity, chemistry, flow conditions in airflow paths (both inside the vaporizer device and in the airways of a human or other animal), and/or mixing of the vaporizable material 102 in the gas phase or in the aerosol phase with other air streams, which can affect one or more physical parameters of an aerosol. In some vaporizer devices, and particularly for vaporizer devices configured for delivery of volatile vaporizable materials, the inhalable dose can exist predominantly in the gas phase (for example, formation of condensed phase particles can be very limited).

The atomizer 141 in the vaporizer device 100 can be configured to vaporize a vaporizable material 102. The vaporizable material 102 can be a liquid. Examples of the vaporizable material 102 include neat liquids, suspensions, solutions, mixtures, and/or the like. The atomizer 141 can include a wicking element (i.e., a wick) configured to convey an amount of the vaporizable material 102 to a part of the atomizer 141 that includes a heating element (not shown in FIG. 1A).

For example, the wicking element can be configured to draw the vaporizable material 102 from a reservoir 140 configured to contain the vaporizable material 102, such that the vaporizable material 102 can be vaporized by heat delivered from a heating element. The wicking element can also optionally allow air to enter the reservoir 140 and replace the volume of vaporizable material 102 removed. In some implementations of the current subject matter, capillary action can pull vaporizable material 102 into the wick for vaporization by the heating element, and air can return to the reservoir 140 through the wick to at least partially equalize pressure in the reservoir 140. Other methods of allowing air back into the reservoir 140 to equalize pressure are also within the scope of the current subject matter.

As used herein, the terms "wick" or "wicking element" include any material capable of causing fluid motion via capillary pressure.

The heating element can include one or more of a conductive heater, a radiative heater, and/or a convective heater. One type of heating element is a resistive heating element, which can include a material (such as a metal or alloy, for example a nickel-chromium alloy, or a non-metallic resistor) configured to dissipate electrical power in the form of heat when electrical current is passed through one or more resistive segments of the heating element. In some implementations of the current subject matter, the atomizer 141 can include a heating element which includes a resistive coil or other heating element wrapped around, positioned within, integrated into a bulk shape of, pressed into thermal contact with, or otherwise arranged to deliver heat to a wicking element, to cause the vaporizable material 102 drawn from the reservoir 140 by the wicking element to be vaporized for subsequent inhalation by a user in a gas and/or a condensed (for example, aerosol particles or droplets) phase. Other wicking elements, heating elements, and/or atomizer assembly configurations are also possible.

The heating element can be activated in association with a user puffing (i.e., drawing, inhaling, etc.) on a mouthpiece 130 of the vaporizer device 100 to cause air to flow from an air inlet, along an airflow path that passes the atomizer 141 (i.e., wicking element and heating element). Optionally, air can flow from an air inlet through one or more condensation areas or chambers, to an air outlet in the mouthpiece 130. Incoming air moving along the airflow path moves over or through the atomizer 141, where vaporizable material 102 in the gas phase is entrained into the air. The heating element can be activated via the controller 104, which can optionally be a part of a vaporizer body 110 as discussed herein, causing current to pass from the power source 112 through a circuit including the resistive heating element, which is optionally part of a vaporizer cartridge 120 as discussed herein. As noted herein, the entrained vaporizable material 102 in the gas phase can condense as it passes through the remainder of the airflow path such that an inhalable dose of the vaporizable material 102 in an aerosol form can be delivered from the air outlet (for example, the mouthpiece 130) for inhalation by a user.

Activation of the heating element can be caused by automatic detection of a puff based on one or more signals generated by one or more of a sensor 113. The sensor 113 and the signals generated by the sensor 113 can include one or more of: a pressure sensor or sensors disposed to detect pressure along the airflow path relative to ambient pressure (or optionally to measure changes in absolute pressure), a motion sensor or sensors (for example, an accelerometer) of the vaporizer device 100, a flow sensor or sensors of the vaporizer device 100, a capacitive lip sensor of the vaporizer device 100, detection of interaction of a user with the vaporizer device 100 via one or more input devices 116 (for example, buttons or other tactile control devices of the vaporizer device 100), receipt of signals from a computing device in communication with the vaporizer device 100, and/or via other approaches for determining that a puff is occurring or imminent.

As discussed herein, the vaporizer device 100 consistent with implementations of the current subject matter can be configured to connect (such as, for example, wirelessly or via a wired connection) to a computing device (or optionally two or more devices) in communication with the vaporizer device 100. To this end, the controller 104 can include communication hardware 105. The controller 104 can also include a memory 108. The communication hardware 105 can include firmware and/or can be controlled by software for executing one or more cryptographic protocols for the communication.

A computing device can be a component of a vaporizer system that also includes the vaporizer device 100, and can include its own hardware for communication, which can establish a wireless communication channel with the communication hardware 105 of the vaporizer device 100. For example, a computing device used as part of a vaporizer system can include a general-purpose computing device (such as a smartphone, a tablet, a personal computer, some other portable device such as a smartwatch, or the like) that executes software to produce a user interface for enabling a user to interact with the vaporizer device 100. In other implementations of the current subject matter, such a device used as part of a vaporizer system can be a dedicated piece of hardware such as a remote control or other wireless or wired device having one or more physical or soft (i.e., configurable on a screen or other display device and selectable via user interaction with a touch-sensitive screen or some other input device like a mouse, pointer, trackball, cursor buttons, or the like) interface controls. The vaporizer device 100 can also include one or more outputs 117 or devices for providing information to the user. For example, the outputs 117 can include one or more light emitting diodes (LEDs) configured to provide feedback to a user based on a status and/or mode of operation of the vaporizer device 100.

In the example in which a computing device provides signals related to activation of the resistive heating element, or in other examples of coupling of a computing device with the vaporizer device 100 for implementation of various control or other functions, the computing device executes one or more computer instruction sets to provide a user interface and underlying data handling. In one example, detection by the computing device of user interaction with one or more user interface elements can cause the computing device to signal the vaporizer device 100 to activate the heating element to reach an operating temperature for creation of an inhalable dose of vapor/aerosol. Other functions of the vaporizer device 100 can be controlled by interaction of a user with a user interface on a computing device in communication with the vaporizer device 100.

The temperature of a resistive heating element of the vaporizer device 100 can depend on a number of factors, including an amount of electrical power delivered to the resistive heating element and/or a duty cycle at which the electrical power is delivered, conductive heat transfer to other parts of the electronic vaporizer device 100 and/or to the environment, latent heat losses due to vaporization of the vaporizable material 102 from the wicking element and/or the atomizer 141 as a whole, and convective heat losses due to airflow (i.e., air moving across the heating element or the atomizer 141 as a whole when a user inhales on the vaporizer device 100). As noted herein, to reliably activate the heating element or heat the heating element to a desired temperature, the vaporizer device 100 may, in some implementations of the current subject matter, make use of signals from the sensor 113 (for example, a pressure sensor) to determine when a user is inhaling. The sensor 113 can be positioned in the airflow path and/or can be connected (for example, by a passageway or other path) to an airflow path containing an inlet for air to enter the vaporizer device 100 and an outlet via which the user inhales the resulting vapor and/or aerosol such that the sensor 113 experiences changes (for example, pressure changes) concurrently with air passing through the vaporizer device 100 from the air inlet to the air outlet. In some implementations of the current subject matter, the heating element can be activated in association with a user's puff, for example by automatic detection of the puff, or by the sensor 113 detecting a change (. such as a pressure change) in the airflow path.

The sensor 113 can be positioned on or coupled to (i.e., electrically or electronically connected, either physically or via a wireless connection) the controller 104 (for example, a printed circuit board assembly or other type of circuit board). To take measurements accurately and maintain durability of the vaporizer device 100, it can be beneficial to provide a seal 127 resilient enough to separate an airflow path from other parts of the vaporizer device 100. The seal 127, which can be a gasket, can be configured to at least partially surround the sensor 113 such that connections of the sensor 113 to the internal circuitry of the vaporizer device 100 are separated from a part of the sensor 113 exposed to the airflow path. In an example of a cartridge-based vaporizer device, the seal 127 can also separate parts of one or more electrical connections between the vaporizer body 110 and the vaporizer cartridge 120. Such arrangements of the seal 127 in the vaporizer device 100 can be helpful in mitigating against potentially disruptive impacts on vaporizer components resulting from interactions with environmental factors such as water in the vapor or liquid phases, other fluids such as the vaporizable material 102, etc., and/or to reduce the escape of air from the designated airflow path in the vaporizer device 100. Unwanted air, liquid or other fluid passing and/or contacting circuitry of the vaporizer device 100 can cause various unwanted effects, such as altered pressure readings, and/or can result in the buildup of unwanted material, such as moisture, excess vaporizable material 102, etc., in parts of the vaporizer device 100 where they can result in poor pressure signal, degradation of the sensor 113 or other components, and/or a shorter life of the vaporizer device 100. Leaks in the seal 127 can also result in a user inhaling air that has passed over parts of the vaporizer device 100 containing, or constructed of, materials that may not be desirable to be inhaled.

In some implementations, the vaporizer body 110 includes the controller 104, the power source 112 (for example, a battery), one more of the sensor 113, charging contacts (such as those for charging the power source 112), the seal 127, and a cartridge receptacle 118 configured to receive the vaporizer cartridge 120 for coupling with the vaporizer body 110 through one or more of a variety of attachment structures. In some examples, the vaporizer cartridge 120 includes the reservoir 140 for containing the vaporizable material 102, and the mouthpiece 130 has an aerosol outlet for delivering an inhalable dose to a user. The vaporizer cartridge 120 can include the atomizer 141 having a wicking element and a heating element. Alternatively, one or both of the wicking element and the heating element can be part of the vaporizer body 110. In implementations in which any part of the atomizer 141 (i.e., heating element and/or wicking element) is part of the vaporizer body 110, the vaporizer device 100 can be configured to supply vaporizable material 102 from the reservoir 140 in the vaporizer cartridge 120 to the part(s) of the atomizer 141 included in the vaporizer body 110.

In an embodiment of the vaporizer device 100 in which the power source 112 is part of the vaporizer body 110, and a heating element is disposed in the vaporizer cartridge 120 and configured to couple with the vaporizer body 110, the vaporizer device 100 can include electrical connection features (for example, means for completing a circuit) for completing a circuit that includes the controller 104 (for example, a printed circuit board, a microcontroller, or the like), the power source 112, and the heating element (for example, a heating element within the atomizer 141). These features can include one or more contacts (referred to herein as cartridge contacts 124*a* and 124*b*) on a bottom surface of the vaporizer cartridge 120 and at least two contacts (referred to herein as receptacle contacts 125*a* and 125*b*) disposed near a base of the cartridge receptacle 118 of the vaporizer device 100 such that the cartridge contacts 124*a* and 124*b* and the receptacle contacts 125*a* and 125*b* make electrical connections when the vaporizer cartridge 120 is inserted into and coupled with the cartridge receptacle 118. The circuit completed by these electrical connections can allow delivery of electrical current to a heating element and can further be used for additional functions, such as measuring a resistance of the heating element for use in determining and/or controlling a temperature of the heating element based on a thermal coefficient of resistivity of the heating element.

In some implementations of the current subject matter, the cartridge contacts 124*a* and 124*b* and the receptacle contacts 125*a* and 125*b* can be configured to electrically connect in either of at least two orientations. In other words, one or more circuits necessary for operation of the vaporizer device 100 can be completed by insertion of the vaporizer cartridge 120 into the cartridge receptacle 118 in a first rotational orientation (around an axis along which the vaporizer cartridge 120 is inserted into the cartridge receptacle 118 of the vaporizer body 110) such that the cartridge contact 124*a* is electrically connected to the receptacle contact 125*a* and the cartridge contact 124*b* is electrically connected to the receptacle contact 125*b*. Furthermore, the one or more circuits necessary for operation of the vaporizer device 100 can be completed by insertion of the vaporizer cartridge 120 in the cartridge receptacle 118 in a second rotational orientation such cartridge contact 124*a* is electrically connected to the receptacle contact 125*b* and cartridge contact 124*b* is electrically connected to the receptacle contact 125*a*.

For example, the vaporizer cartridge 120 or at least the insertable end 122 of the vaporizer cartridge 120 can be symmetrical upon a rotation of 180° around an axis along which the vaporizer cartridge 120 is inserted into the cartridge receptacle 118. In such a configuration, the circuitry of the vaporizer device 100 can support identical operation regardless of which symmetrical orientation of the vaporizer cartridge 120 occurs.

In one example of an attachment structure for coupling the vaporizer cartridge 120 to the vaporizer body 110, the vaporizer body 110 includes one or more detents (for example, dimples, protrusions, etc.) protruding inwardly from an inner surface of the cartridge receptacle 118, additional material (such as metal, plastic, etc.) formed to include a portion protruding into the cartridge receptacle 118, and/or the like. One or more exterior surfaces of the vaporizer cartridge 120 can include corresponding recesses (not shown in FIG. 1A) that can fit and/or otherwise snap over such detents or protruding portions when the vaporizer cartridge 120 is inserted into the cartridge receptacle 118 on the vaporizer body 110. When the vaporizer cartridge 120 and the vaporizer body 110 are coupled (e.g., by insertion of the vaporizer cartridge 120 into the cartridge receptacle 118 of the vaporizer body 110), the detents or protrusions of the vaporizer body 110 can fit within and/or otherwise be held within the recesses of the vaporizer cartridge 120, to hold the vaporizer cartridge 120 in place when assembled. Such an assembly can provide enough support to hold the vaporizer cartridge 120 in place to ensure good contact between the cartridge contacts 124*a* and 124*b* and the receptacle contacts 125*a* and 125*b*, while allowing release of the vaporizer cartridge 120 from the vaporizer body 110 when a user pulls with reasonable force on the vaporizer cartridge 120 to disengage the vaporizer cartridge 120 from the cartridge receptacle 118.

In some implementations, the vaporizer cartridge 120, or at least an insertable end 122 of the vaporizer cartridge 120 configured for insertion in the cartridge receptacle 118, can have a non-circular cross section transverse to the axis along which the vaporizer cartridge 120 is inserted into the cartridge receptacle 118. For example, the non-circular cross section can be approximately rectangular, approximately elliptical (i.e., have an approximately oval shape), non-rectangular but with two sets of parallel or approximately parallel opposing sides (i.e., having a parallelogram-like shape), or other shapes having rotational symmetry of at least order two. In this context, approximate shape indicates that a basic likeness to the described shape is apparent, but that sides of the shape in question need not be completely linear and vertices need not be completely sharp. Rounding of both or either of the edges or the vertices of the cross-sectional shape is contemplated in the description of any non-circular cross section referred to herein.

The cartridge contacts 124*a* and 124*b* and the receptacle contacts 125*a* and 125*b* can take various forms. For example, one or both sets of contacts can include conductive pins, tabs, posts, receiving holes for pins or posts, or the like. Some types of contacts can include springs or other features to facilitate better physical and electrical contact between the contacts on the vaporizer cartridge 120 and the vaporizer body 110. The electrical contacts can optionally be gold-plated, and/or include other materials.

Figure 1B:
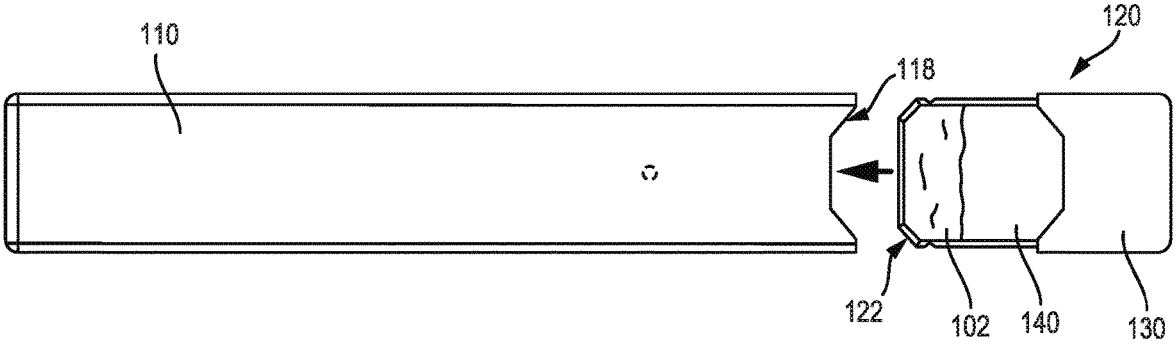
FIG. 1B is a top view of an embodiment of a vaporizer device, showing a vaporizer cartridge separated from a vaporizer device body.
Figure 1C:
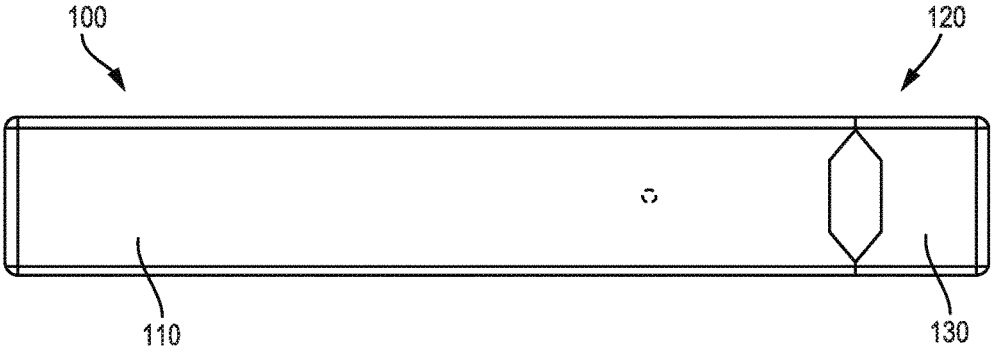
FIG. 1C is a top view of the vaporizer device of FIG. 1B, showing the vaporizer cartridge coupled to the vaporizer device body.
Figure 1D:
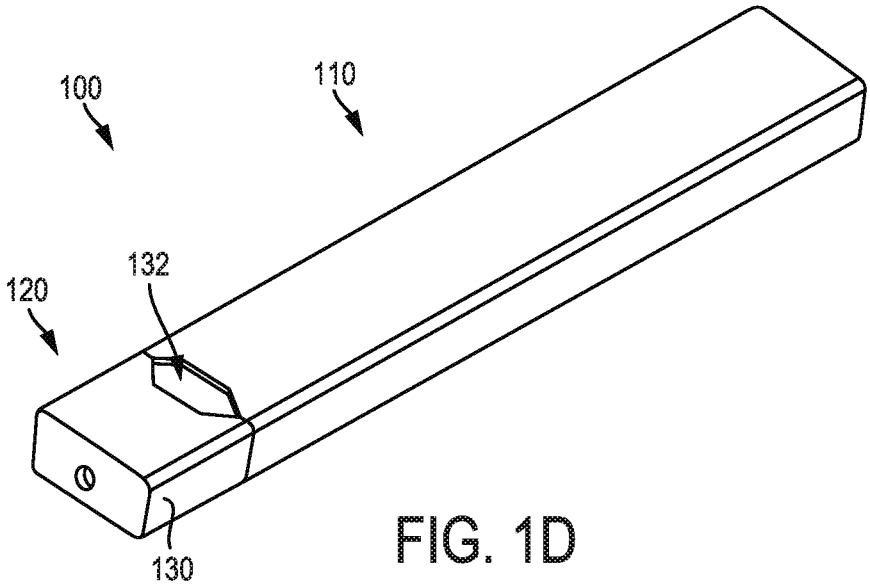
FIG. 1D is a perspective view of the vaporizer device of FIG. 1C.

FIGS. 1B-1D illustrate an embodiment of the vaporizer body 110 having a cartridge receptacle 118 into which the vaporizer cartridge 120 can be releasably inserted. FIGS. 1B and 1C show top views of the vaporizer device 100 illustrating the vaporizer cartridge 120 being positioned for insertion and inserted, respectively, into the vaporizer body 110. FIG. 1D illustrates the reservoir 140 of the vaporizer cartridge 120 being formed in whole or in part from translucent material such that a level of the vaporizable material 102 is visible from a window 132 (e.g., translucent material) along the vaporizer cartridge 120. The vaporizer cartridge 120 can be configured such that the window 132 remains visible when insertably received by the vaporizer cartridge receptacle 118 of the vaporizer body 110. For example, in one exemplary configuration, the window 132 can be disposed between a bottom edge of the mouthpiece 130 and a top edge of the vaporizer body 110 when the vaporizer cartridge 120 is coupled with the cartridge receptacle 118.

Figure 1E:
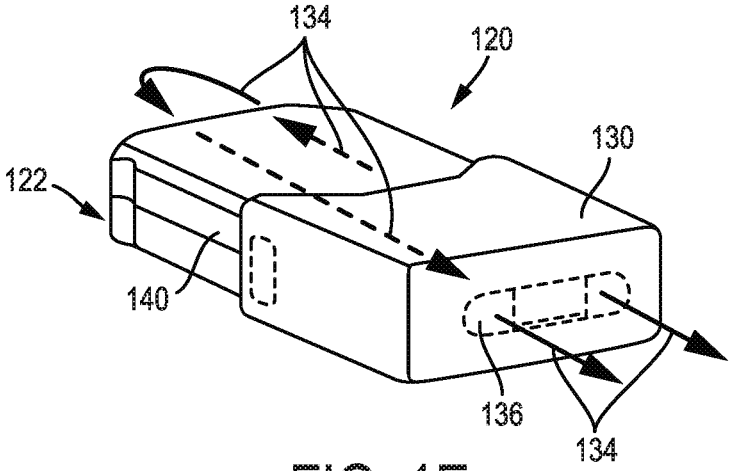
FIG. 1E is a perspective view of the vaporizer cartridge of FIG. 1B.

FIG. 1E illustrates an example airflow path 134 created during a puff by a user on the vaporizer device 100. The airflow path 134 can direct air to a vaporization chamber 150 (see FIG. 1F) contained in a wick housing where the air is combined with inhalable aerosol for delivery to a user via a mouthpiece 130, which can also be part of the vaporizer cartridge 120. For example, when a user puffs on the vaporizer device 100 device 100, air can pass between an outer surface of the vaporizer cartridge 120 (for example, window 132 shown in FIG. 1D) and an inner surface of the cartridge receptacle 118 on the vaporizer body 110. Air can then be drawn into the insertable end 122 of the vaporizer cartridge 120, through the vaporization chamber 150 that includes or contains the heating element and wick, and out through an outlet 136 of the mouthpiece 130 for delivery of the inhalable aerosol to a user.

As shown in FIG. 1E, this configuration causes air to flow down around the insertable end 122 of the vaporizer cartridge 120 into the cartridge receptacle 118 and then flow back in the opposite direction after passing around the insertable end 122 (e.g., an end opposite of the end including the mouthpiece 130) of the vaporizer cartridge 120 as it enters into the cartridge body toward the vaporization chamber 150. The airflow path 134 then travels through the interior of the vaporizer cartridge 120, for example via one or more tubes or internal channels (such as cannula 128 shown in FIG. 1F) and through one or more outlets (such as outlet 136) formed in the mouthpiece 130. The mouthpiece 130 can be a separable component of the vaporizer cartridge 120 or can be integrally formed with other component(s) of the vaporizer cartridge 120 (for example, formed as a unitary structure with the reservoir 140 and/or the like).

Figure 1F:
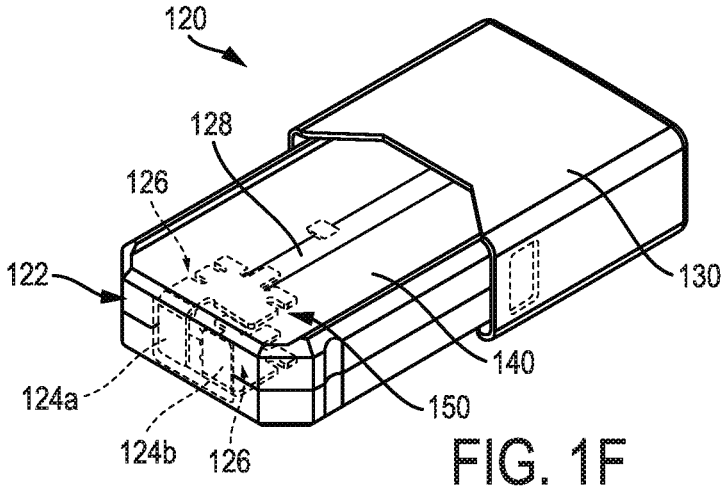
FIG. 1F is another perspective view of the vaporizer cartridge of FIG. 1E.

FIG. 1F shows additional features that can be included in the vaporizer cartridge 120 consistent with implementations of the current subject matter. For example, the vaporizer cartridge 120 can include a plurality of cartridge contacts (such as cartridge contacts 124*a*, 124*b*) disposed on the insertable end 122. The cartridge contacts 124*a*, 124*b* can optionally each be part of a single piece of metal that forms a conductive structure (such as conductive structure 126) connected to one of two ends of a resistive heating element. The conductive structure can optionally form opposing sides of a heating chamber and can act as heat shields and/or heat sinks to reduce transmission of heat to outer walls of the vaporizer cartridge 120. FIG. 1F also shows the cannula 128 within the vaporizer cartridge 120 that defines part of the airflow path 134 between the heating chamber formed between the conductive structure 126 and the mouthpiece 130.

As mentioned above, the air volume, and thus, the headspace, in a cartridge reservoir having vaporizable material disposed therein can expand as the ambient pressure decreases relative to the internal pressure of the cartridge reservoir. Various events can cause the ambient pressure to decrease, for example, the application of heat, manual pressure, any type of negative pressure event (e.g., pressure drop inside an airplane cabin), etc. This change in pressure increases the headspace within the reservoir which causes the vaporizable material to overflow out of any opening of the cartridge reservoir and leak to the environment or other portions of the cartridge. For example, these undesirable leaks typically occur at an end where the cartridge reservoir is connected to a mouthpiece or in a cavity area where a cartridge's electric ports are positioned to engage a power source. Further, such leaks can also result in a user inhaling air that has passed over parts of the vaporizer device containing or constructed of materials that may not be desirable to be inhaled. Various features and devices are described below that improve upon or overcome these issues. For example, various features are described herein for inhibiting vaporizable material from leaking into other portions of the vaporizer device and/or out of the vaporizer device itself and into an external environment. Avoiding leakage may provide advantages and improvements relative to existing approaches, while also introducing additional benefits as described herein.

The vaporizer cartridges described herein are configured to substantially control, substantially limit, or substantially prevent leaks of a liquid or semi-liquid vaporizable material contained with a cartridge reservoir in response to a decrease in ambient pressure (e.g., due to a negative pressure event) relative to the internal pressure of the reservoir, and thus in response to an increase in headspace within the reservoir. The vaporizer cartridges generally include a primary reservoir and a secondary reservoir that are in fluid communication with each other. The primary reservoir is configured to store a majority fraction of vaporizable material and the secondary reservoir is configured to absorb a surplus of vaporizable material that is displaced from the primary reservoir in response to a pressure-related change. As discussed in more detail below, the secondary reservoir is formed of an absorbent material that is configured to absorb a first volume of vaporizable material when the primary reservoir is in a first pressure state (e.g., when the ambient pressure outside of the primary reservoir and the internal pressure of the primary reservoir are substantially equal) and to absorb a second volume of vaporizable material (e.g., surplus or overflow of vaporizable material) when the primary reservoir is in a second pressure state (e.g., when the ambient pressure outside of the reservoir is less than the internal pressure of the primary reservoir.) As such, when in the second pressure state, a surplus of vaporizable material flows from the primary reservoir to the secondary reservoir. This surplus is absorbed by and temporarily stored within the secondary reservoir during the second pressure state, thereby substantially preventing any leakage thereof. At least a portion of this surplus can be subsequently withdrawn from the secondary reservoir for vaporization by a heating element. Alternatively or additionally, a portion of the surplus can be drawn back into the primary reservoir while the change in pressure subsides or concludes. Thus, the secondary reservoir functions as a temporary buffer that allows the surplus of vaporizable material to be reused as opposed to leaking out of the vaporizer cartridge or being permanently trapped within the secondary reservoir. Further, when the primary reservoir is in the first pressure state, the secondary reservoir allows the vaporizable material to flow therethrough, rather than substantially diverting flow, as is the case when the primary reservoir is in the second pressure state.

Figure 2:
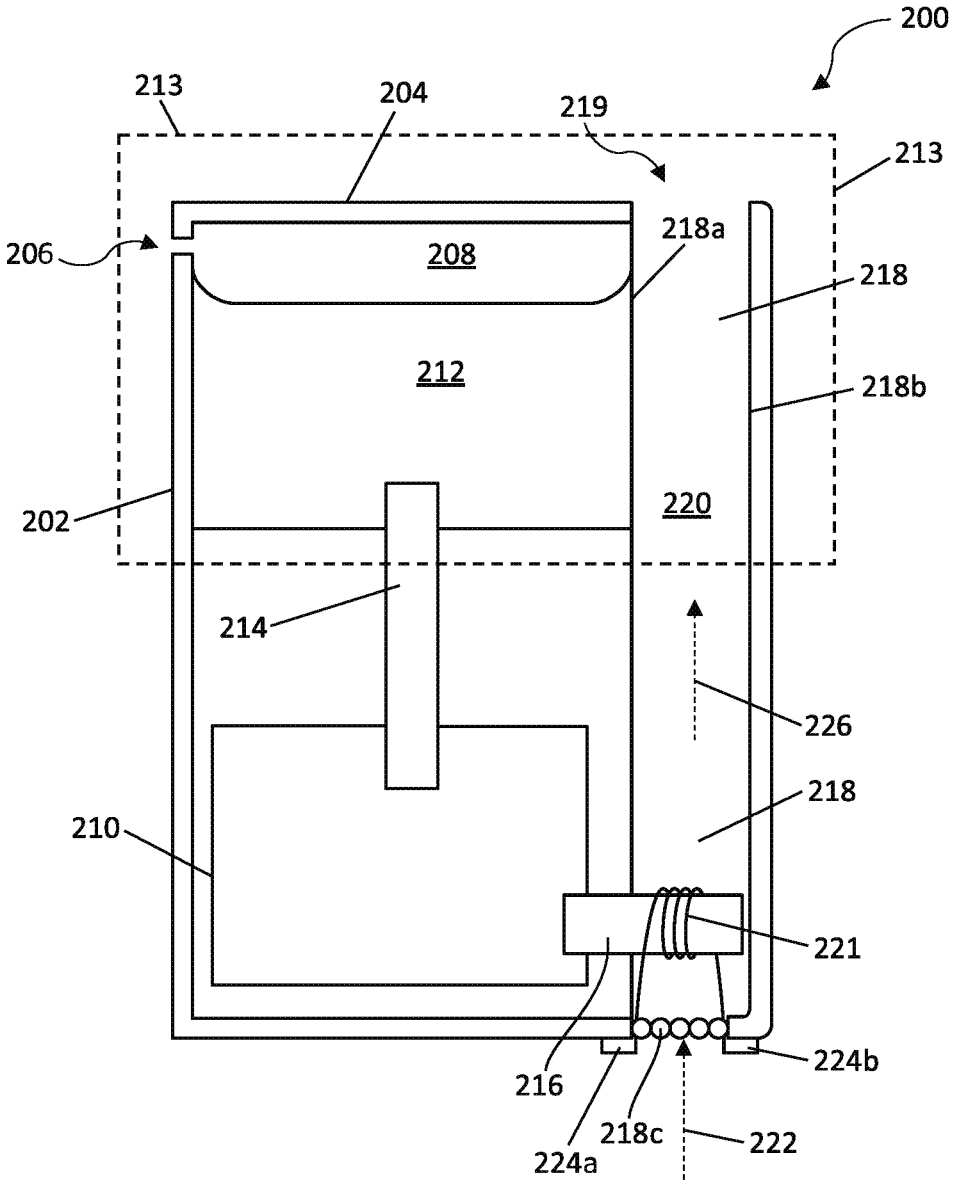
FIG. 2 illustrates a schematic of another embodiment of a vaporizer cartridge.

FIG. 2 illustrates an exemplary vaporizer cartridge 200 that can be selectively coupled to and removable from a vaporizer body, such as vaporizer body 110 shown in FIGS. 1A-1D). More specifically, the vaporizer cartridge 200 includes a secondary reservoir 210 formed of absorbent material that is configured to absorb a surplus (e.g., an overflow volume) of a vaporizable material 212 that is expelled from a primary reservoir 202 as a headspace 208 in the primary reservoir 202 increases in response to a pressure-changing event. For purposes of simplicity, certain components of the vaporizer cartridge 200 are not illustrated.

As shown, the vaporizer cartridge 200 includes a primary reservoir 202, a secondary reservoir 210, a first wicking element 214 extending between the primary and secondary reservoirs 202, 210, a vaporization chamber 218, and a second wicking element 216 extending between the vaporization chamber 218 and the secondary reservoir 210. The primary reservoir 202 includes a majority fraction of vaporizable material 212 disposed therein. The headspace 208 (e.g., volume of air) is between the vaporizable material 212 and a top wall 204 of the primary reservoir 202. In some implementations, ambient air may enter and/or exit the primary reservoir 202 through the first wicking element 214 and/or other opening, such as a vent 206 as shown in FIG. 2. That is, the primary reservoir 202 can be in communication with ambient air.

While the primary reservoir 202 can have a variety of shapes and configurations, the primary reservoir 202, as shown in FIG. 2, has a substantially rectangular shape. In other embodiments, the primary reservoir 202 can be sized and shaped differently, including any other possible shape. As such, the amount of vaporizable material 212 disposed therein is dependent at least in part on the size and shape of the primary reservoir 202. Further, depending on the amount of vaporizable material 212 and the size of the primary reservoir 202, the headspace 208 within the primary reservoir 202 can vary. A person skilled in the art will appreciate that throughout the use of the vaporizer cartridge 200, the headspace 208 of the primary reservoir 202 will increase as the vaporizable material 212 is drawn out of the primary reservoir 202 irrespective of a pressure-changing event.

As shown in FIG. 2, the secondary reservoir 210 is in fluid communication with the primary reservoir 202 through the first wicking element 214. The first wicking element 214 can be any suitable material that allows the vaporizable material 212 to flow therethrough under capillary pressure. Non-limiting examples of suitable materials include one or more ceramics, one or more cottons, one or more polymers, and the like. In one embodiment, the first wicking element 214 can include metal. In another embodiment, the first wicking element 214 can be a grooved solid in a porous material. In some embodiments, the secondary reservoir 210 is in fluid communication with the primary reservoir 202 through two or more wicking elements.

As such, the vaporizable material 212 can be withdrawn from the primary reservoir 202 through capillary action of the first wicking element 214 and into the secondary reservoir 210. As discussed in more detail below, the secondary reservoir 210 is configured to receive and to retain the delta of the first and second volumes of the vaporizable material 212 that is withdrawn and expelled from the primary reservoir 202, respectively, such that at a given draw rate, the flow rate of vaporizable material 212 remains substantially constant. Thus, the secondary reservoir 210 serves as a buffer for retention of the surplus of vaporizable material 212 displaced from the primary reservoir 202 in the second pressure state.

While the secondary reservoir 210 can have a variety of shapes, sizes, and configurations, the secondary reservoir 210, as shown in FIG. 2, is substantially rectangular shaped. As such, the amount of surplus vaporizable material the secondary reservoir 210 can temporarily retain depends at least in part on the shape and size of the secondary reservoir 210. Further, the secondary reservoir 210 can be positioned relative to the primary reservoir 202 in a variety of different locations, and therefore the secondary reservoir 210 is not limited to the position shown in FIG. 2.

The secondary reservoir 210 is formed of the absorbent material. As such, the amount of surplus vaporizable material that can be temporarily retained in the secondary reservoir 210 is also dependent on the absorption properties of the absorbent material relative to the vaporizable material 212. The absorbent material can be any suitable material that is capable of carrying out a capillary action for allowing vaporizable material 212 to pass through and infuse. That is, the absorbent material possess sufficient capillary drive to allow vaporizable material 212 to pass therethrough and into the vaporization chamber 218 at desired times (e.g., as a user puffs on a mouthpiece 213 coupled to the vaporizer cartridge 200), while also being capable of temporarily storing any displaced vaporizable material from the primary reservoir 202 in response to an undesirable increase in headspace within the primary reservoir 202. Non-limiting examples of suitable absorbent materials includes a porous material, a fibrous material, a hook and loop material, and the like. In some embodiments, the absorbent material is open to ambient air. While a mouthpiece 213 is shown in FIG. 2, a person skilled in the art will appreciate that in other embodiments, the mouthpiece 213 can be omitted and the user can directly puff on the cartridge at an outlet (such as outlet 219 of vaporization chamber 218). For purposes of simplicity, certain components of the vaporizer cartridge 200 are not illustrated.

As shown, the secondary reservoir 210 is in communication with the vaporization chamber 218 via the second wicking element 216. As such, the vaporizable material 212 can be withdrawn through the second wicking element 216 (e.g., through capillary action), and into the vaporization chamber 218 for vaporization by heating element 221, as described in more detail below.

While the absorbent material can have a variety of configurations, the absorbent material can be configured to have a consistent absorption rate throughout, or alternatively a varying absorption rate, at a given pressure. In some embodiments, the absorbent material can include voids. The voids can form a substantially continuous network of openings throughout the absorbent material. In some embodiments, the voids can have the same size and/or shape. In other embodiments, the sizes and/or shapes of the voids can vary. In varying the size and/or shape of the voids, the absorbent material can have varying absorption rates at a given pressure.

In use, when the primary reservoir 202 is in the first pressure state, a majority fraction of the vaporizable material 212 is stored therein. The first pressure state may exist, for example, when ambient pressure is substantially equal to the internal pressure of the primary reservoir 202. In this first pressure state, a first volume of the vaporizable material 212 is withdrawn from the primary reservoir 202 through the first wicking element 214 (e.g., via capillary action) and into the secondary reservoir 210. After which, the first volume is withdrawn from the secondary reservoir 210 through the second wicking element 216 (e.g., through capillary action) and into the vaporization chamber 218 for vaporization. That is, in this first pressure state, the first volume flows from the primary reservoir 202 through the secondary reservoir 210 and into the vaporization chamber 218.

When a negative pressure event occurs, a pressure differential is created between the ambient pressure outside of the primary reservoir 202 and the internal pressure of the primary reservoir 202, thereby forcing the primary reservoir 202 into a second pressure state. The second pressure state may exist, for example, when ambient pressure is less than the internal pressure of the primary reservoir 202. It should be noted that other events could cause the primary reservoir 202 to be in the second pressure state (e.g., changes in ambient temperature relative to the temperature within the primary reservoir 202, or deformation of the primary reservoir 202, expansion of the vaporizable material due to temperature changes and/or absorption of water vapor, etc.). In this second pressure state, a second volume of the vaporizable material 212, which is greater than the first volume, is forcibly expelled through the first wicking element 214 (e.g., due to an increase in headspace within the primary reservoir 202) and into the secondary reservoir 210. After which, a portion of the vaporizable material 212 is withdrawn from the secondary reservoir 210 through the second wicking element 216 and into the vaporization chamber 218 for vaporization, whereas the surplus of vaporizable material 212 (i.e., the delta volume between the first and second volumes) is temporarily retained in the secondary reservoir 210. The retained surplus of vaporizable material 212 can be withdrawn from the secondary reservoir 210 into either the vaporization chamber 218 (e.g., when a user subsequently puffs on the mouthpiece 213) or back into the primary reservoir 202 (e.g., when the negative pressure event subsides or concludes).

As further shown in FIG. 2, the vaporizer cartridge 200 includes a heating element 221 disposed within the vaporization chamber 218. The heating element 221 is configured to vaporize at least a portion of the vaporizable material drawn from the secondary reservoir 210 and into the second wicking element 216, and thus into the vaporization chamber 218. The heating element 221 can be or include one or more of a conductive heater, a radiative heater, and a convective heater. As discussed above, one type of heating element is a resistive heating element, such as a resistive coil, which can be constructed of or at least include a material (e.g., a metal or alloy, for example a nickel-chromium alloy, or a non-metallic resistor) configured to dissipate electrical power in the form of heat when electrical current is passed through one or more resistive segments of the heating element. As shown in FIG. 2, the heating element 221 is in the form of a resistive coil.

In some embodiments, the vaporizer cartridge 200 includes two or more cartridge contacts such as, for example, a first cartridge contact 224*a* and a second cartridge contact 224*b*. The two or more cartridge contacts can be configured to couple, for example, with the receptacle contacts 125*a* and 125*b* in order to form one or more electrical connections with the vaporizer body 110. The circuit completed by these electrical connections can allow delivery of electrical current to the heating element 221. The circuit can also serve additional functions such as, for example, measuring a resistance of the heating element 221 for use in determining and/or controlling a temperature of the heating element 221 based on a thermal coefficient of resistivity of the heating element 221.

While the vaporization chamber 218 can have a variety of configurations, the vaporization chamber 218, as shown in FIG. 2, is defined by two opposing sidewalls 218*a*, 218*b* and a bottom wall 218*c* extending therebetween. As shown, an airflow passageway 220 extends through the vaporization chamber 218. The airflow passageway 220 is configured to direct air, illustrated as dash-lined-lined arrow 222, through the vaporization chamber 218 so that the air 222 will mix with the vaporized material to form an aerosol, illustrated as dash-lined arrow 226. The airflow passageway 220 further directs the aerosol 226 through the vaporization chamber 218 and into the mouthpiece 213 for inhalation by a user.

As shown, the air 222 enters the vaporization chamber 218 through the bottom wall 218*c* as a user puffs the mouthpiece 213. As such, the bottom wall 218*c* is configured to allow airflow to readily pass therethrough and into the vaporization chamber 218. While the bottom wall 218*c* can have a variety of configurations, the bottom wall 218*c* is perforated, as shown in FIG. 2. The perforations can be of any suitable size that allows air to pass through the bottom wall 218*c*. In certain embodiments, the size of the perforations can prevent the vaporizable material 212 and/or aerosol 226 present in the vaporization chamber 218 through the bottom wall 218*c*, and therefore prevent undesirable leakage into other portions of the vaporizer cartridge 200 and/or a vaporizer body, such as vaporizer body 110 shown in FIGS. 1A-ID, coupled to the vaporizer cartridge 200. The bottom wall 218*c* can include any suitable number of perforations, and therefore the number of perforations is not limited by what is illustrated in the FIG. 2. Alternatively or in addition, the bottom wall 218*c* can be formed of an air permeable material. Thus, the bottom wall 218*c* functions as an air inlet for the vaporization chamber 218.

The bottom wall 218*c* can also be configured to prevent air 222 within the vaporization chamber 218 from passing back therethrough and out of the vaporization chamber 218. That is, the bottom wall 218*c* can be configured as a one-way valve, and therefore only allow air 222 to pass through and into the vaporization chamber 218. In some embodiments, any of the remaining walls of the vaporization chamber 218 can be perforated and/or formed of an air permeable material to allow air to pass into (or out of) the vaporization chamber 218 as desired.

In some embodiments, at least one wall of the vaporization chamber 218 can be formed of or coated with a hydrophobic material so as to prevent or reduce any condensation from accumulating within the vaporization chamber 218. As such, any water that may be present in the aerosol 226 and air 222 can be carried through and out of the vaporization chamber 218 as the user puffs on the mouthpiece 213.

While the second wicking element 216 can be positioned anywhere along the airflow passageway 220, the second wicking element, as shown in FIG. 2, is positioned proximate to the bottom wall 218*c* of the vaporization chamber 218. The second wicking element 216 can be any suitable material that allows the vaporizable material 212 to flow therethrough under capillary pressure. For example, the second wicking element 216 can be formed of one or more ceramic materials, one or more cottons, or one or more polymers. Alternatively or in addition, the second wicking element 216 can be a composite of two or more materials, such as an inner material (e.g., graphite) surrounded by an outer material (e.g., a ceramic material). In one embodiment, the second wicking element 216 is a grooved solid in a porous material.

In some embodiments, the second wicking element 216 may be formed of a porous material that includes a conductive material. For example, the ceramic material of the second wicking element 216 may be doped to include resistive properties. Such doping of the wick material (e.g., ceramic) can increase the rate of heating of the second wicking element, and thus the rate of vaporization of the vaporizable material 212.

Some embodiments can include a second wicking element 216 having a cross-section that varies along a length of the wicking element. For example, a part of the second wicking element 216 that includes a smaller cross-section compared to another part of the second wicking element 216 may, for example, result in greater resistance against energy flow, thereby allowing faster evaporation and vaporization of vaporizable material 212, such as for forming an aerosol for inhalation by a user. In some implementations, at least one of the cross-section dimensions and the density of conductive material can vary along a length of the second wicking element, such as to achieve varying results (e.g., rate of vaporization, rate of heating, etc.).

While the embodiments of the vaporizer cartridge have been discussed in the context of at least two wicking elements, alternative embodiments of the vaporizer cartridge may employ a single wick. For example, in some embodiments, a vaporizer cartridge, such as vaporizer cartridge 200 (FIG. 2), can include a single wicking element, such as either first or second wicking element 214, 216 (FIG. 2), extending from a primary reservoir, such as primary reservoir 202 (FIG. 2), through a secondary reservoir, such as secondary reservoir 210 (FIG. 2), and into a vaporization chamber, such as vaporization chamber 218 (FIG. 2).

Terminology

For purposes of describing and defining the present teachings, it is noted that unless indicated otherwise, the term "substantially" is utilized herein to represent the inherent degree of uncertainty that may be attributed to any quantitative comparison, value, measurement, or other representation. The term "substantially" is also utilized herein to represent the degree by which a quantitative representation may vary from a stated reference without resulting in a change in the basic function of the subject matter at issue.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present.

Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments and implementations only and is not intended to be limiting. For example, as used herein, the singular forms "a," "an," and "the" are intended to include the plural forms as well, unless the context clearly indicates otherwise.

In the descriptions above and in the claims, phrases such as "at least one of" or "one or more of" may occur followed by a conjunctive list of elements or features. The term "and/or" may also occur in a list of two or more elements or features. Unless otherwise implicitly or explicitly contradicted by the context in which it used, such a phrase is intended to mean any of the listed elements or features individually or any of the recited elements or features in combination with any of the other recited elements or features. For example, the phrases "at least one of A and B;" "one or more of A and B;" and "A and/or B" are each intended to mean "A alone, B alone, or A and B together." A similar interpretation is also intended for lists including three or more items. For example, the phrases "at least one of A, B, and C;" "one or more of A, B, and C;" and "A, B, and/or C" are each intended to mean "A alone, B alone, C alone, A and B together, A and C together, B and C together, or A and B and C together." Use of the term "based on," above and in the claims is intended to mean, "based at least in part on," such that an unrecited feature or element is also permissible.

Spatially relative terms, such as "forward", "rearward", "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings provided herein.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical values given herein should also be understood to include about or approximately that value, unless the context indicates otherwise. For example, if the value "10" is disclosed, then "about 10" is also disclosed. Any numerical range recited herein is intended to include all sub-ranges subsumed therein. It is also understood that when a value is disclosed that "less than or equal to" the value, "greater than or equal to the value" and possible ranges between values are also disclosed, as appropriately understood by the skilled artisan. For example, if the value "X" is disclosed the "less than or equal to X" as well as "greater than or equal to X" (e.g., where X is a numerical value) is also disclosed. It is also understood that the throughout the application, data is provided in a number of different formats, and that this data, represents endpoints and starting points, and ranges for any combination of the data points. For example, if a particular data point "10" and a particular data point "15" are disclosed, it is understood that greater than, greater than or equal to, less than, less than or equal to, and equal to 10 and 15 are considered disclosed as well as between 10 and 15. It is also understood that each unit between two particular units are also disclosed. For example, if 10 and 15 are disclosed, then 11, 12, 13, and 14 are also disclosed.

Although various illustrative embodiments are described above, any of a number of changes may be made to various embodiments without departing from the teachings herein. For example, the order in which various described method steps are performed may often be changed in alternative embodiments, and in other alternative embodiments, one or more method steps may be skipped altogether. Optional features of various device and system embodiments may be included in some embodiments and not in others. Therefore, the foregoing description is provided primarily for exemplary purposes and should not be interpreted to limit the scope of the claims.

One or more aspects or features of the subject matter described herein can be realized in digital electronic circuitry, integrated circuitry, specially designed application specific integrated circuits (ASICs), field programmable gate arrays (FPGAs) computer hardware, firmware, software, and/or combinations thereof. These various aspects or features can include implementation in one or more computer programs that are executable and/or interpretable on a programmable system including at least one programmable processor, which can be special or general purpose, coupled to receive data and instructions from, and to transmit data and instructions to, a storage system, at least one input device, and at least one output device. The programmable system or computing system may include clients and servers. A client and server are generally remote from each other and typically interact through a communication network. The relationship of client and server arises by virtue of computer programs running on the respective computers and having a client-server relationship to each other.

These computer programs, which can also be referred to programs, software, software applications, applications, components, or code, include machine instructions for a programmable processor, and can be implemented in a high-level procedural language, an object-oriented programming language, a functional programming language, a logical programming language, and/or in assembly/machine language. As used herein, the term "machine-readable medium" refers to any computer program product, apparatus and/or device, such as for example magnetic discs, optical disks, memory, and Programmable Logic Devices (PLDs), used to provide machine instructions and/or data to a programmable processor, including a machine-readable medium that receives machine instructions as a machine-readable signal. The term "machine-readable signal" refers to any signal used to provide machine instructions and/or data to a programmable processor. The machine-readable medium can store such machine instructions non-transitorily, such as for example as would a non-transient solid-state memory or a magnetic hard drive or any equivalent storage medium. The machine-readable medium can alternatively or additionally store such machine instructions in a transient manner, such as for example, as would a processor cache or other random access memory associated with one or more physical processor cores.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description. Use of the term "based on," herein and in the claims is intended to mean, "based at least in part on," such that an unrecited feature or element is also permissible.

The subject matter described herein can be embodied in systems, apparatus, methods, and/or articles depending on the desired configuration. The implementations set forth in the foregoing description do not represent all implementations consistent with the subject matter described herein. Instead, they are merely some examples consistent with aspects related to the described subject matter. Although a few variations have been described in detail herein, other modifications or additions are possible. In particular, further features and/or variations can be provided in addition to those set forth herein. For example, the implementations described herein can be directed to various combinations and subcombinations of the disclosed features and/or combinations and subcombinations of several further features disclosed herein. In addition, the logic flows depicted in the accompanying figures and/or described herein do not necessarily require the particular order shown, or sequential order, to achieve desirable results. Other implementations may be within the scope of the following claims.

What is claimed is:

1. A cartridge for a vaporizer device, the cartridge comprising:

a primary reservoir being configured to hold a majority fraction of vaporizable material, the primary reservoir having an internal pressure;

a secondary reservoir being formed of an absorbent material, the absorbent material configured to receive an overflow volume of the vaporizable material that is expelled from the primary reservoir in response to a pressure differential that is created between ambient pressure outside of the primary reservoir and the internal pressure of the primary reservoir; and a first wicking element extending between the primary and secondary reservoirs, the first wicking element configured to draw the vaporizable material from the primary reservoir into the secondary reservoir.

2. The cartridge of claim 1, further comprising a vaporization chamber in communication with the secondary reservoir.

3. The cartridge of claim 2, wherein the vaporization chamber comprises a second wicking element configured to draw the vaporizable material from the secondary reservoir to the vaporization chamber for vaporization by a heating element.

4. The cartridge of claim 3, wherein the second wicking element is configured to draw the overflow volume of the vaporizable material from the secondary reservoir to the vaporization chamber.

5. The cartridge of claim 4, wherein the vaporization chamber includes a third wicking element configured to draw the vaporizable material from the secondary reservoir to the vaporization chamber for vaporization by the heating element.

6. The cartridge of claim 1, wherein the pressure differential is associated with a negative pressure event.

7. The cartridge of claim 1, wherein the internal pressure of the primary reservoir is less than or equal to the ambient pressure prior to the pressure differential being created.

8. The cartridge of claim 1, wherein the ambient pressure is less than the internal pressure of the primary reservoir when the pressure differential is created.

9. The cartridge of claim 1, wherein the first wicking element is configured to withdraw at least a portion of the overflow volume of the vaporizable material from the secondary reservoir back to the primary reservoir in response to a decrease of the pressure differential.

10. A vaporizer device, comprising:

a vaporizer body; and a cartridge that is selectively coupled to and removable from the vaporizer body, the cartridge including:

a primary reservoir being configured to hold a majority fraction of vaporizable material, the primary reservoir having an internal pressure;

a secondary reservoir being formed of an absorbent material, the absorbent material configured to receive an overflow volume of the vaporizable material that is expelled from the primary reservoir in response to a pressure differential that is created between ambient pressure outside of the primary reservoir and the internal pressure of the primary reservoir;

a first wicking element extending between the primary and secondary reservoirs, the first wicking element configured to draw the vaporizable material from the primary reservoir into the secondary reservoir.

11. The device of claim 10, wherein the vaporizer body includes a power source.

12. The device of claim 10, further comprising a mouthpiece coupled to the cartridge.

13. The device of claim 10, further comprising a vaporization chamber in communication with the secondary reservoir.

14. The device of claim 13, wherein the vaporization chamber comprises a second wicking element configured to draw the vaporizable material from the secondary reservoir to the vaporization chamber for vaporization by a heating element.

15. The device of claim 14, wherein the second wicking element is configured to draw the overflow volume of the vaporizable material from the secondary reservoir to the vaporization chamber.

16. The device of claim 15, wherein the vaporization chamber includes a third wicking element configured to draw the vaporizable material from the secondary reservoir to the vaporization chamber for vaporization by the heating element.

17. The device of claim 10, wherein the pressure differential is associated with a negative pressure event.

18. The device of claim 10, wherein the internal pressure of the primary reservoir is less than or equal to the ambient pressure prior to the pressure differential being created.

19. The device of claim 10, wherein the ambient pressure is less than the internal pressure of the primary reservoir when the pressure differential is created.

20. The device of claim 10, wherein the first wicking element is configured to withdraw at least a portion of the overflow volume of the vaporizable material from the secondary reservoir back to the primary reservoir in response to a decrease of the pressure differential.

* * * * *